US007635405B2

(12) United States Patent
Lu et al.

(10) Patent No.: US 7,635,405 B2
(45) Date of Patent: Dec. 22, 2009

(54) SINTERING PROCESS AND TOOLS FOR USE IN METAL INJECTION MOLDING OF LARGE PARTS

(75) Inventors: Jyh-Woei J. Lu, Chandler, AZ (US); Kenneth J. Bartone, Mahwah, NJ (US); Donald M. Olson, Dover, NJ (US); Dwayne M. Benson, Tempe, AZ (US); John N. Tervo, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 768 days.

(21) Appl. No.: 10/989,446

(22) Filed: Nov. 15, 2004

(65) Prior Publication Data

US 2005/0064221 A1 Mar. 24, 2005

Related U.S. Application Data

(62) Division of application No. 10/142,330, filed on May 9, 2002, now Pat. No. 6,838,046.

(60) Provisional application No. 60/291,054, filed on May 14, 2001, provisional application No. 60/290,853, filed on May 14, 2001.

(51) Int. Cl.
*B22F 3/00* (2006.01)

(52) U.S. Cl. ..... 75/228; 75/246

(58) Field of Classification Search ..... 75/228, 75/246; 419/5

See application file for complete search history.

(56) References Cited

U.S. PATENT DOCUMENTS

| | | | | | |
|---|---|---|---|---|---|
| 3,499,066 | A | * | 3/1970 | Murray | 264/629 |
| 3,615,382 | A | * | 10/1971 | Manilla et al. | 419/38 |
| 3,823,463 | A | * | 7/1974 | Weaver et al. | 29/417 |
| 3,888,663 | A | | 6/1975 | Reichman | |
| 4,383,854 | A | * | 5/1983 | Dembowski et al. | 419/1 |
| 4,602,952 | A | * | 7/1986 | Greene et al. | 75/228 |
| 4,687,185 | A | | 8/1987 | Urano et al. | |
| 4,818,301 | A | * | 4/1989 | Khare | 419/1 |
| 5,577,889 | A | * | 11/1996 | Terazaki et al. | 416/97 R |

FOREIGN PATENT DOCUMENTS

| | | |
|---|---|---|
| JP | 61-096008 | 5/1986 |
| JP | 03-271334 | 12/1991 |
| JP | 05-171218 | 7/1993 |
| JP | 07-113102 | 5/1995 |
| JP | 07-150287 | 6/1995 |

* cited by examiner

*Primary Examiner*—Roy King
*Assistant Examiner*—Ngoclan T Mai
(74) *Attorney, Agent, or Firm*—Ingrassia Fisher & Lorenz, P.C.

(57) ABSTRACT

Improved drying, binder evaporation, and sintering processes which may be used in conjunction with specialized sintering tools to provide for the geometrically stable sintering of large, complex, metal injection molded preform parts or flowbodies. The improved process includes a three-stage drying process, a single stage binder evaporation process, and a two-stage sintering process.

8 Claims, 3 Drawing Sheets

SINTERING PROCESS AND TOOLS FOR USE IN METAL INJECTION MOLDING OF LARGE PARTS

CROSS-REFERENCE TO RELATED APPLICATION(S)

This application is a divisional of Ser. No. 10/142,330 filed on May 9, 2002 now U.S. Pat. No. 6,838,046. This application claims priority to provisional application No. 60/291,054, filed May 14, 2001 and to provisional application No. 60/290,853, filed May 14, 2001.

BACKGROUND OF THE INVENTION

The present invention relates to the art of sintering metal injection molded preforms or flowbodies, and more particularly to a two-step sintering process and related tools for controlling flowbody deformation which typically occurs during the sintering process.

Metal injection molding (MIM) is a well known technique for the cost effective production of complex multidimensional parts. Typically such parts are of comparatively small size with a weight within a range of about 25 to about 250 grams and are often made in high production volumes. Metal injection molding is most commonly used in the automotive, firearms, and medical industries.

In general, the MIM process involves mixing a powder metal, water and a binder. The binder is typically composed of an organic aqueous based gel. The mixed powder metal and binder composition produces a generally flowable mixture at relatively low temperature and pressure. The proportion of binder to powder metal is typically about 40-60% binder by volume. The goal is to produce a flowable mixture with a viscosity such that the mixture will fill all of the crevices and small dimensional features of a mold. The flowable mixture is typically transferred to the mold, via an injection molding machine.

Injection molding machines are known in the art and are typically capable of applying several hundred tons of pressure to a mold. The mold is typically constructed with internal cooling passages to solidify the flowable material prior to removal. The mold cavity typically is larger than that of the desired finished part to account for the shrinkage that occurs after binder removal. The mold structure may be formed from either a rigid or a flexible material, such as metal, plastic, or rubber. Preferably, the mold is equipped with vents or bleeder lines to allow air to escape from the mold during the molding process. Alternatively, the mold may be equipped with a porous metal or ceramic insert to allow air to escape from the mold. After the mold has been filled with the flowable mixture, pressure is applied to the mold/mixture to form the molded part, otherwise known as the preform. Typical injection mold pressures for a preform are in the range of about 10-12 ksi. The as molded preforms may be referred to as "green" parts. The green preform may be dried by oven heating to a temperature sufficient to vaporize most of the remaining water. Then, the preform is placed in a furnace to vaporize the binder. To achieve a part with high density and thus a sufficient working strength, the preform is subsequently sintered.

Sintering is an elevated temperature process whereby a powder metal preform may be caused to coalesce into an essentially solid form having the same or nearly the same mechanical properties as the material in casted or wrought form. Generally, sintering refers to raising the temperature of the powder metal preform to a temperature close to, but not exceeding, the melting point of the material, and holding it there for a defined period of time. Under these conditions, interparticulate melting occurs and the material densifies to become solid.

In general, complete solidification does not occur, but sintered density can approach 99% with some materials. As the densification process occurs, the interstitial voids in the preform shrink in size and decrease in number. As a result, the bulk volume of the sintered preform is considerably less than that of the pre-sintered preform. As the preform shrinks, geometric deformation of the preform may occur. This deformation is relatively minor in small parts and can be easily remedied by secondary machining operations. However, in large parts, those with net weights over 250 grams, undesired deformation is more problematic.

In general, during the period of densification, while the preform is subjected to high temperature, preforms of certain configurations, such as tubular or other shapes, have less strength to resist deforming influences and it is a recognized challenge in sintering such metal parts to achieve final geometries congruent to the preform. See, e.g., U.S. Pat. No. 5,710,969. This problem is particularly apparent when sintering preforms with large cylindrical sections and irregular high mass protrusions. For example, a large cylindrical preform section will deform under the influence of gravity to a densified section in the form of an oval. For this reason, the use of MIM and sintering technology has not expanded to the production of comparatively large parts weighing in excess of about 250 grams, or to parts having cylindrical sections with diameters in excess of about 3.8 cm. What is needed therefore is a sintering method and tools which will allow for comparatively larger parts to be sintered while maintaining the geometric stability of the parts.

SUMMARY OF THE INVENTION

The invention provides a process and/or tools that can be used to make dimensionally accurate MIM parts of a size and/or complexity heretofore unachievable and includes improved drying, binder removal, and sintering processes which may be used in conjunction with specialized sintering tools to provide for the geometrically stable sintering of large, complex, MIM parts.

By way of example only, the improved processes include a four-stage drying process, a single stage binder removal process, and a two-stage sintering process. Drying of wet green preforms is particularly important as cracks often form during the drying process, resulting in a large number of scrap parts. This problem is particularly prevalent with large MIM parts.

The novel two stage sintering process includes a first fixing stage where the MIM molded preform may be densified to about 60% to 80% of its maximum density at a first sintering temperature, and then allowed to cool. Generally, the sintering temperature used in the first sintering stage is sufficiently below the melting point of the powder metal material used in the molding process to prevent the preform from taking an improper set due to the force of gravity acting over any large unsupported surfaces. It may prove desirable to keep the first sintering temperature below the solidus temperature of the alloy (i.e., the temperature at which the alloy begins to melt). This first stage serves to fix the overall shape of the preform.

In the second stage, the preform is heated to a second sintering temperature near the melting point of the powdered metal material at which a denser part density is developed.

Typically, in a preform part containing both large and small cylindrical features, heat resistant sintering tools such as inserts of predetermined sizes may be used in both the first and second sintering stages. Heat resistant materials, such as aluminum oxide ceramic may be used for the inserts. In the first sintering stage, the inserts are used to support the preform and control the diameter of any small cylindrical features. In the second sintering stage, the larger cylindrical features may be fitted with a second set of inserts to prevent undue deformation of these features due to the force of gravity that otherwise would cause the features to take an oval or other undesired shape during the sintering.

These and other features of the invention will become more apparent from the following detailed description of the invention, when taken in conjunction with the accompanying exemplary drawings.

DETAILED DESCRIPTION OF THE INVENTION

In this specification the term "preform" is meant to include conventional powder metal preforms where the powder metal is compacted without the use of a binder. The term "preform" is also meant to include MIM flowbodies where the flowbody is produced from a mixture of a powder metal, water and a binder. A flowbody is a structure or part with a flow passage formed therein, such as the portion of a valve assembly having the fluid flow passage formed therein.

Throughout this specification the process and tools of the present invention will be referred to in reference to a particular flowbody produced from a commercially available Inconel 718 powder metal composition with a nominal chemistry composition of 52.5Ni-18.5Fe-18.5Cr-5.1Nb-3Mo-0.9Ti-0.5Al-0.4C (% by weight) mixed with a binder comprising an aqueous agar solution.

In general, the various temperatures and heating times are applicable to any Inconel alloy composition. Those skilled in the art will understand that the sintering process of the present invention may be applied to virtually any metal alloy, including but not limited to iron, nickel, and titanium based alloys. Sintering temperatures and times for alloys other than Inconel 718 will of course vary from those described. Further, the processes of the present invention may be used with virtually any preform or MIM flowbody configuration and the tools of the invention may be used with any preform or flowbody having large and small cylindrical features.

Figure 1:
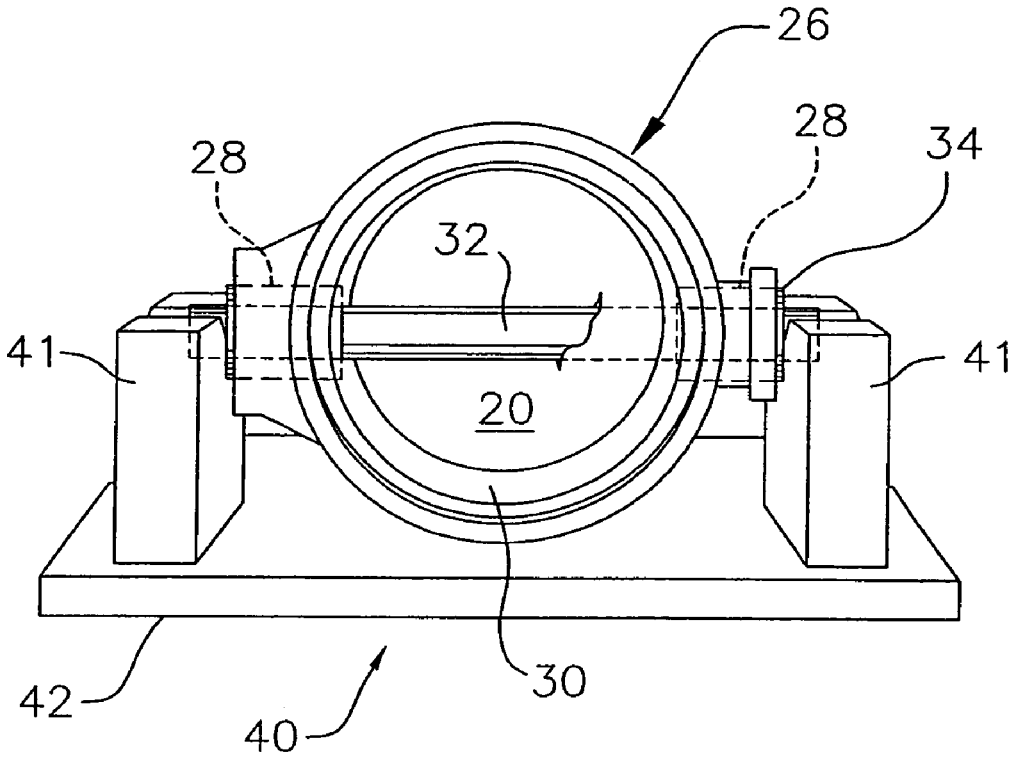
FIG. 1 is a perspective view of a valve flowbody prepared for first stage sintering with sintering tools in accordance with the present invention.

With reference to FIG. 1, there is shown an exemplary flowbody 26 prepared for first stage sintering. The flowbody is a butterfly valve housing having a large cylindrical bore 30 with an inside diameter of about 8.8 cm and a pair of smaller cylindrical bores 28 having an inside diameter of about 3.0 cm. The typical wall thickness of the flowbody's features is about 3 mm. The flowbody has a weight of about 1000 grams or substantially in excess of parts typically made by MIM processes. The flowbody includes a diaphragm 20 which is formed during the molding process and which helps provide support for roundness of the flowbody. The diaphragm, however, is not required for all applications and is removed before or after sintering, as desired.

The flowbody is produced using the processes and tools of the present invention and is dimensionally and geometrically representative of the type of large flowbodies which may be successfully produced using the present invention processes. The processes and tools can also be used to make other large complex MIM parts. It is believed that the present invention processes are suitable for sintering flowbodies with weights of up to at least 1500 grams and with cylindrical features having diameters in excess of 8 cm.

Figure 3:
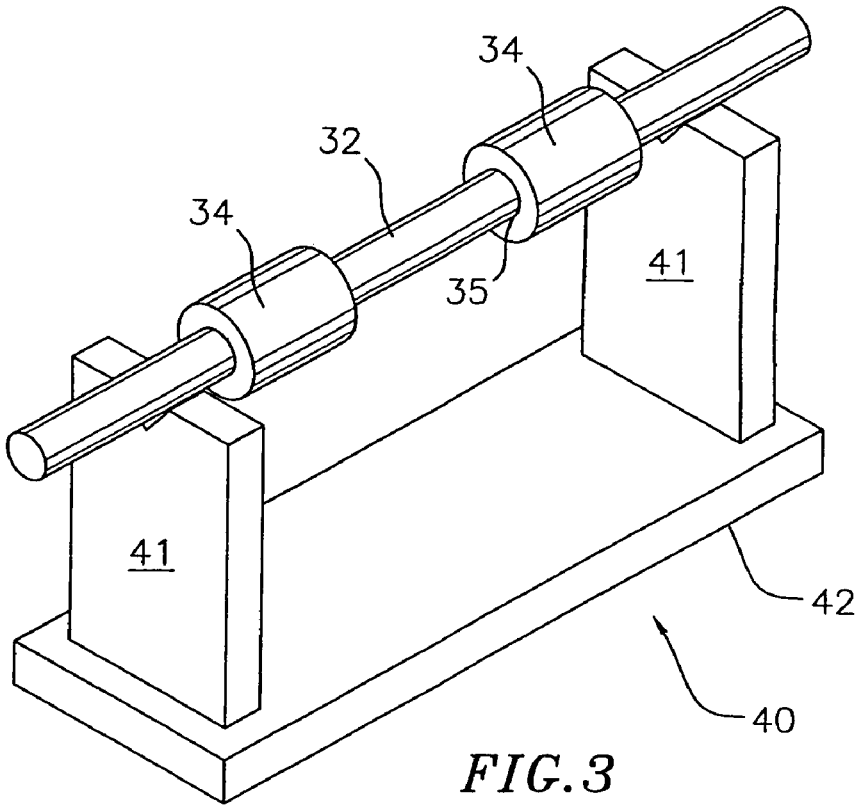
FIG. 3 is a perspective view showing the sintering tools of FIG. 1 in more detail.

As shown in FIG. 1, supporting the flowbody are specialized sintering tools. In particular, within each small bore is placed a ceramic insert, e.g., a cylinder 34 (see also FIG. 3). Each cylinder functions to maintain the geometry of the respective bore in which it is placed, and to support, via a ceramic rod 32, the flowbody during first stage sintering. Each of the cylinders includes a throughbore 35 (FIG. 3) which slidably receives the ceramic rod 32. The ceramic rod, which may be solid or tubular, rests in a ceramic support structure 40, such as a firebrick support structure. The support structure may include a base 42 and a pair of V-notch blocks 41 (FIG. 3) for receipt of the ceramic rod. The configuration of the first stage sintering tools 32, 34, 41, and 42 are shown with more particularity in FIG. 3. The flowbody 26 is supported by the ceramic rod 32, through the cylinders 34 such that the flowbody is spaced from the base 42.

It will be appreciated that for smaller parts having smaller bores, the cylinders 34 may be removed and the part supported by the ceramic rod 32 only. In this case, the ceramic rod may or may not be used to insure roundness of the bore. For example, the rod may be used to support the part, but is not needed to maintain roundness of a relatively small bore. In addition, the orientation of the flowbody relative to the support structure may be varied as desired. For example, FIG. 1 depicts the large cylindrical bore 30 having a horizontal axis. The part may be rotated on the ceramic rod, however, such that the bore 30 has a vertical axis.

Figure 2:
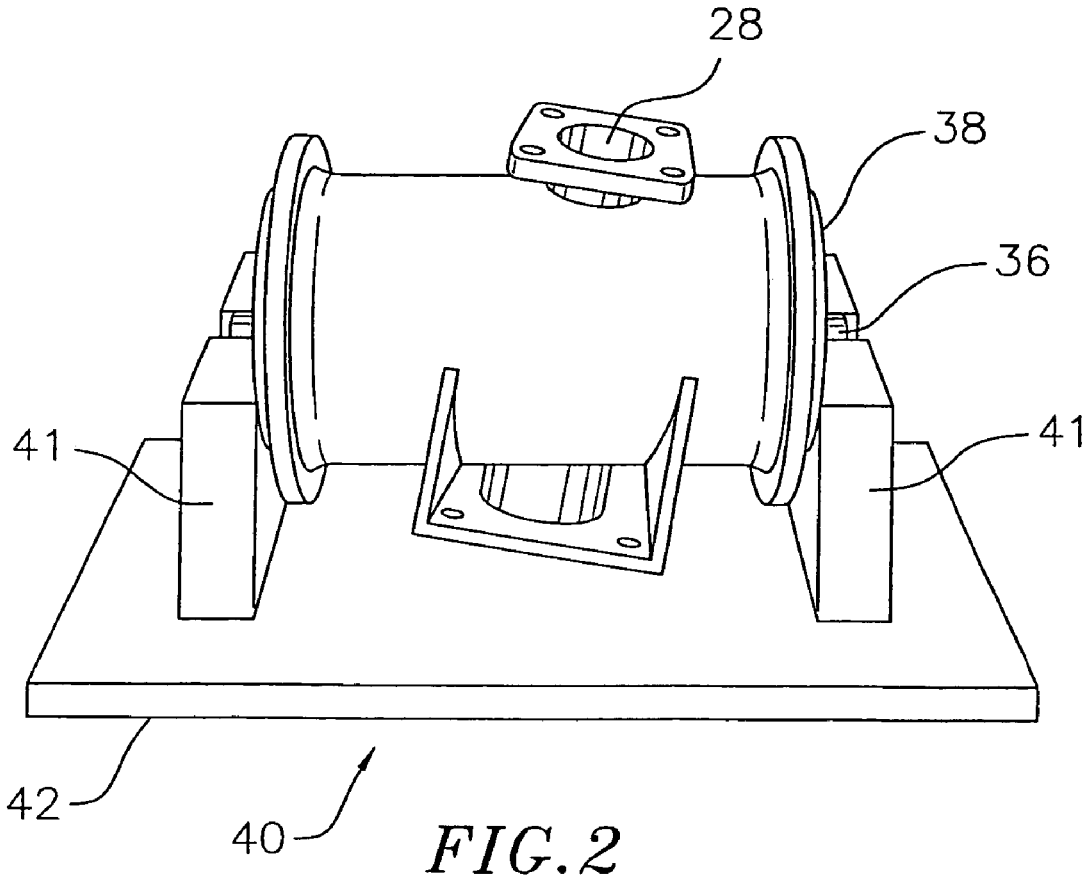
FIG. 2 is another perspective view of the flowbody of FIG. 1 prepared for second stage sintering with additional sintering tools in accordance with the present invention.
Figure 4:
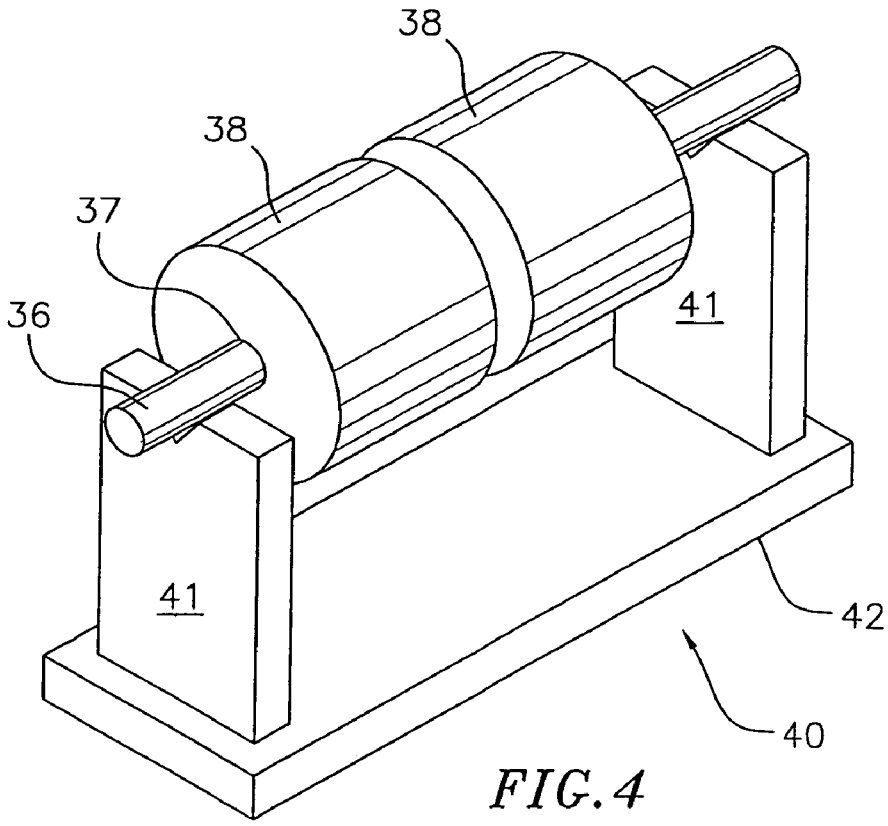
FIG. 4 is a perspective view showing the sintering tools of FIG. 2 in more detail.

Referring now to FIG. 2, the flowbody 26 is shown prepared for second stage sintering. Placed within the large bore 30 are two large diameter ceramic inserts, e.g., cylinders 38 (see also FIG. 4). Like the smaller ceramic cylinders used during the first stage sintering, these cylinders serve to maintain the geometry of the bore and to support the flowbody during sintering, via a ceramic rod 36. The ceramic rod can be the same rod as used in the first stage sintering. Referring now to FIG. 4, the second stage sintering tools are shown in more detail. The cylinders 38 each have a throughbore 37 for slidable receipt of the rod 36. The rod 36 supports the cylinders and consequently the flowbody in the firebrick support structure 40. The same support structure can be used for the first and second sintering stages. In the second sintering stage, the flowbody is also supported by the ceramic rod through the cylinders such that the flowbody is spaced from the base.

The sintering tools are preferably produced from commercially available aluminum oxide ceramic. Aluminum oxide is a durable material that will neither deform nor stick to the Indonel 718 metallic flowbody during sintering. The sintering tools may be made by machining aluminum oxide bar stock or by an injection molding process known in the art. Preferably, the outside diameter of the cylinders 34 and 38 is machined to the desired inside diameter of the final dimensions of the bores in which they are placed. In this manner, the desired final dimensions of the flowbody cylindrical features may be more easily controlled as the flowbody shrinks around the cylinders during sintering. In many instances it will be desirable to machine the diameter of the cylinders 34 and 38 to a diameter smaller than the final inside diameter of the flowbody's cylindrical features to provide a small amount of excess material for secondary machining operations. It should be appreciated that the inserts could instead be of any shape needed to form the bore during the sintering process, as may be required by the geometry of the desired end part.

Figure 5:
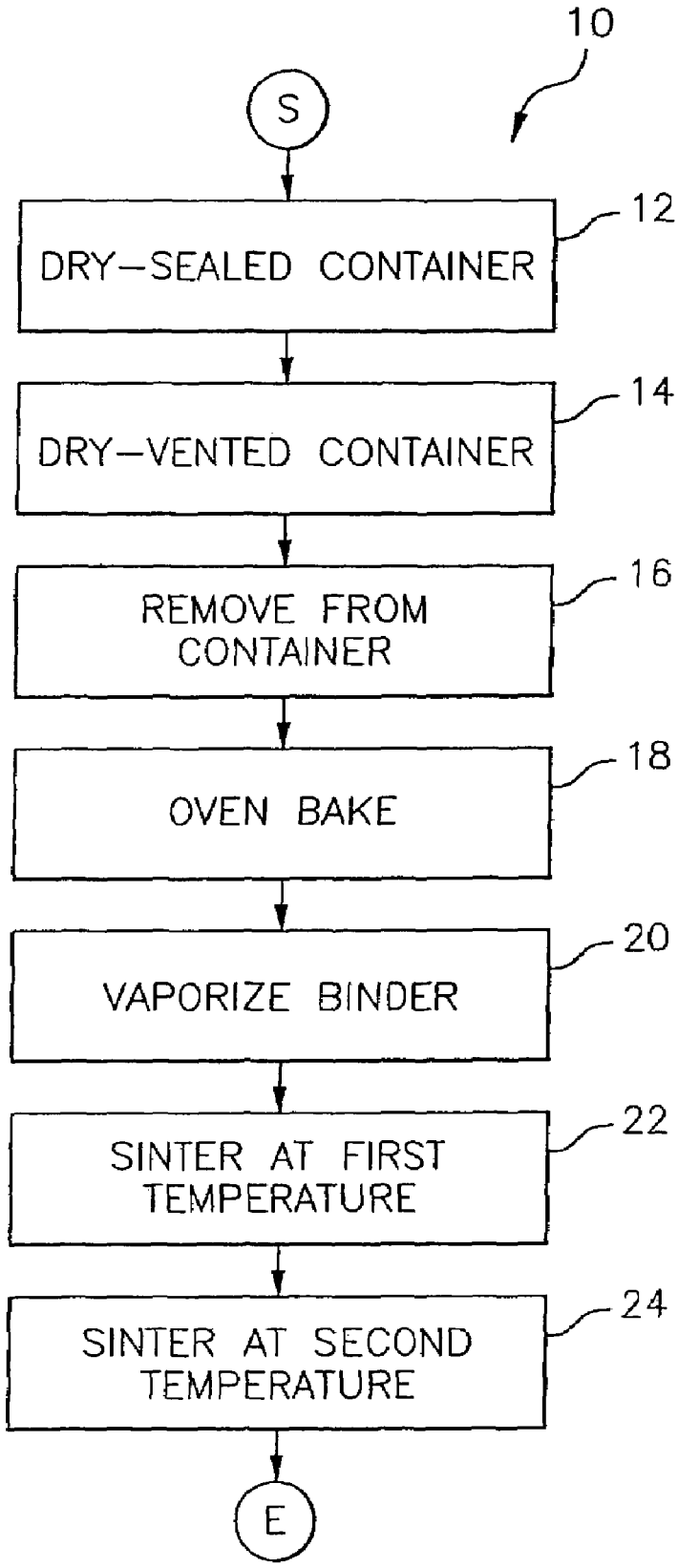
FIG. 5 is a flow chart illustrating the steps of the present invention drying, binder evaporation, and sintering processes.

With reference to FIG. 5, the present invention sintering process will be described in detail. Steps 12-18 comprise the wet green MIM part drying process. Prior art drying processes call for quickly drying MIM parts at an elevated temperature. This procedure is effective with small parts. However, large MIM parts with comparatively large cylindrical features tend to crack during a quick drying process leading to an unacceptably high number of scrap parts. It is believed that this is due to the rapid vaporization of water from the flowbody binder causing differential shrinkage between thick and thin flowbody sections and between drier outer (external) portions and wetter internal portions. Thus, an important step in successfully producing large MIM parts is removing the water from the parts without producing cracks.

In step 12, one or more of the freshly-molded green flowbodies are sealed in containers or bags, which may be made of plastic or any other suitable material. The sealed containers are stored for a 2-3 day period at room temperature and atmospheric pressure. During this time water vapor evaporates from each flowbody and condenses on the container or bag walls. In step 14, the sealed container or bag is vented to the atmosphere to initiate a slow drying rate. The flowbody is then stored in this state for a period of three to five days. During this period, water evaporates from the formerly sealed container or bag and water vapor continues to evaporate from the flowbody.

In step 16, each flowbody is removed from the vented container and is allowed to dry on a shelf or other support for an additional two to three days. In general, testing has revealed that it is important to slowly dry the green flowbody to prevent crack formation. However, the duration of time the flowbody is dried in the sealed and vented container and on the shelf may vary considerably depending upon factors such as the size and wall thickness of the particular flowbody. Therefore, the drying times mentioned are meant to be examples only.

The time periods stated above were used to produce crack free flowbodies of the type shown in FIG. 1. In step 18, the flowbody is baked at 60°±5° C. in an oven at atmospheric pressure for about 24 hours. The low temperature oven baking vaporizes any remaining water in the flowbody. At the completion of the drying process, a dry green flowbody typically loses about 7% of its "as molded" weight. In step 20, the flowbody is heated in a furnace to about 275° C.±5° C. for about two hours. This step vaporizes the non-aqueous portion of binder from the flowbody. At this point, the dry green flowbody is ready for sintering.

Further testing has indicated that the addition of one or more additives to the binder may permit a quicker drying process, which does not require placing the green flowbody in a container or bag, and which, for some applications, may result in a product that is ready for sintering after drying the green flowbody at room temperature for 2-3 days or less. This quicker drying method, however, appears to adversely affect surface finish, e.g., pitting. Testing is not complete and it has not been determined whether this addition of additives to the binder to reduce drying time is preferred for any particular application. While the drying method depicted in FIG. 5 is believed to be an acceptable method, it should be appreciated that other drying methods are contemplated and that the sintering method to be described may be used with any suitably dried green MIM part.

For first stage sintering, the flowbody is setup with the ceramic tools 32, 34, 41 and 42 as described above. In step 22, the flowbody is placed in a high-vacuum furnace and is heated preferably to about 1235° C. for a period of about thirty minutes. The goal of first stage sintering is to substantially fix the overall shape of the part. Thus, at 1235° C. for a duration of thirty minutes, some inter-particulate melting will occur in the flowbody. Generally, this melting occurs on the exterior surfaces of the flowbody. The typical density of an Inconel 718 flowbody after first stage sintering is about 60% to 80% of the maximum obtainable density. During the first stage sintering, the flowbody is not heated close enough to the melting point of the metal alloy to become sufficiently plastic such that gravity acting on the flowbody can cause significant deformation of the flowbody.

Although temperature control during the sintering process is important, some variation in temperature is permissible. For example, for first stage sintering 1100° C. to 1240° C. is an acceptable working range for the flowbody. A temperature range of 1230° C. to 1240° C. may also be used. The duration for which the flowbody is heated may also vary depending upon the geometry of the flowbody. Flowbodies with thin walls may require less sintering time, and correspondingly, flowbodies with thick walled sections may require longer sintering times.

Generally, after first stage sintering, the flowbody is removed from the high-vacuum furnace and allowed to cool for a period of several hours between first and second stage sintering. This cooling period is not critical to the process and primarily allows the first stage sintering tools to be removed from the flowbody and the second stage sintering tools to be installed in the flowbody. One or more flowbodies may be processed simultaneously using the process and tools described herein.

In step 24, the second stage sintering tools 36, 38, 41, and 42 are installed in the flowbody which is again placed in the high-vacuum furnace. The flowbody is now heated to a temperature of about 1280° C.±5° C. for a period of about thirty minutes. A temperature above about 1270° C. may also be used. The goal of second stage sintering is to achieve increased or even maximum densification of the flowbody. Temperature control is more critical in second stage sintering as the flowbody is heated to a temperature near the melting point of the alloy composition. In this regard, the sintering temperature should not exceed the melting point of the alloy. Test results reveal that using the 1280° C.±5° C. second stage sintering, the densification approaches 99% of the density of the alloy in its wrought form. Conducting the second stage sintering at temperatures below 1275° C. is entirely possible. At lower second stage sintering temperatures, less flowbody densification is achieved in a given time and correspondingly the finished part has a higher porosity and somewhat reduced working strength. This is entirely acceptable for parts where maximum strength is not required. After the second stage sintering, the flowbody may be machined and/or heat treated as desired. For example, the flowbody is solution heat treated and further treated by precipitation hardening to reach the desired mechanical property. This procedure is known in the art.

A cast flowbody and an MIM flowbody typically have different surface characteristics. A cast flowbody has a surface roughness of about 250 micro inches, while an MIM flowbody has a surface roughness of less than about 30 micro inches. Less material is wasted in the MIM process and less machining is required as compared to casting, and therefore it is less expensive to make parts with the MIM process.

It will be appreciated that a new multi-stage MIM part drying and sintering process has been presented. These new processes allow for comparatively large MIM parts to be sintered while maintaining good dimensional control of the part's geometry. In addition, specialized aluminum oxide ceramic sintering tools which assist in maintaining precise dimensions of large cylindrical features have also been presented. While only the presently preferred embodiments have been described in detail, as will be apparent to those skilled in the art, modifications and improvements may be made to the system and method disclosed herein without departing from the scope of the invention. Accordingly, it is not intended that the invention be limited except by the appended claims.

What is claimed is:

1. An Inconel 718 flowbody having a first pair of cylindrical bores and a second pair of cylindrical bores, wherein the second pair of cylindrical bores is larger in diameter than the first pair of bores, and wherein the density of the flowbody is at least 98% of the density of wrought Inconel 718 alloy.

2. The flowbody of claim 1, wherein the flowbody has a weight greater than about 250 grams.

3. The flowbody of claim 1, wherein at least one bore of the first pair of cylindrical bores and the second pair of cylindrical bores has a diameter greater than about 3.8 cm.

4. The flowbody of claim 1 wherein the flowbody has a weight greater than about 300 grams.

5. The flowbody of claim 1 wherein the flowbody has a weight greater than about 1000 grams.

6. The flowbody of claim 1, wherein at least one of the first pair of cylindrical bores and the second pair of cylindrical bores has a diameter greater than about 8 cm.

7. The flowbody of claim 1, wherein at least one of the first pair of cylindrical bores and the second pair of cylindrical bores has a diameter greater than about 5 cm.

8. The flowbody of claim 1, wherein the flowbody has a surface roughness of less than about 30 micro inches.

* * * * *

UNITED STATES PATENT AND TRADEMARK OFFICE

CERTIFICATE OF CORRECTION

PATENT NO. : 7,635,405 B2
APPLICATION NO. : 10/989446
DATED : December 22, 2009
INVENTOR(S) : Lu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1400 days.

Signed and Sealed this

Ninth Day of November, 2010

David J. Kappos

David J. Kappos
*Director of the United States Patent and Trademark Office*